US007430978B2

(12) United States Patent
Rezzonico

(10) Patent No.: US 7,430,978 B2
(45) Date of Patent: Oct. 7, 2008

(54) FENDER FOR BOATS WITH INTERNAL CONDUIT

(75) Inventor: Massimo Rezzonico, Sirtori (LC) (IT)

(73) Assignee: Tessilmare s.r.l., Como (IT)

( * ) Notice: Subject to any disclaimer, the term of this patent is extended or adjusted under 35 U.S.C. 154(b) by 0 days.

(21) Appl. No.: 11/589,712

(22) Filed: Oct. 31, 2006

(65) Prior Publication Data

US 2007/0107648 A1 May 17, 2007

(30) Foreign Application Priority Data

Nov. 8, 2005 (IT) ..... MI20050390 U

(51) Int. Cl.
*B63B 59/02* (2006.01)

(52) U.S. Cl. ..... 114/219

(58) Field of Classification Search ..... 114/219; 428/100; 52/717.05
See application file for complete search history.

(56) References Cited

U.S. PATENT DOCUMENTS

| | | | | |
|---|---|---|---|---|
| 4,083,592 | A * | 4/1978 | Rubin et al. | 52/717.05 |
| 4,227,832 | A * | 10/1980 | Leone et al. | 405/215 |
| 4,946,727 | A * | 8/1990 | Kessler | 428/99 |
| 5,013,596 | A * | 5/1991 | Kessler | 428/100 |
| 5,096,753 | A * | 3/1992 | McCue et al. | 428/31 |
| 2002/0178684 | A1 * | 12/2002 | Barnett | 52/716.1 |

* cited by examiner

*Primary Examiner*—Stephen Avila
(74) *Attorney, Agent, or Firm*—Jacobson Holman PLLC

(57) ABSTRACT

A fender for boats consisting of an internal portion fixed to an edge of the boat and of an external portion adapted to absorb external shock. The external portion includes an internal conduit adapted to couple with a complementarily shaped protuberance belonging to the internal portion.

4 Claims, 1 Drawing Sheet

FENDER FOR BOATS WITH INTERNAL CONDUIT

The present invention relates to a fender for boats with an internal conduit.

The edges of boats often collide with external objects during mooring manoeuvres.

The pilot's ability is put to the test both when a boat enters the harbour and when another boat is approached.

The turbulent nature of water in which the boat navigates makes it often impossible to avoid hard collisions which can seriously damage the edge of the boat.

In addition to evident aesthetic damage, dangerous cracks may appear which in time may expand and compromise boat safety.

Fenders capable of limiting the effect of said collisions are usually applied to the external edge of the boat.

Fenders consisting of an internal conduit of rigid material (aluminium or PVC) fixed to the edge and adapted to engage with an external portion of soft material (PVC) for damping external collisions are known.

The external portion presents an internal part whose shape is complementary to the conduit to ensure connection.

Said conduit does not always mate perfectly with the boat because boats are never perfectly straight.

This causes the presence of cracks which are normally filled with silicon after fastening the internal portion.

However in time these cracks may reappear requiring the replacement of the conduit, operation which is not easy because the conduit is securely fixed to the edge.

Despite being made of either PVC or aluminium, the conduit is always rather rigid. Consequently, the assembly of the external portion is difficult because the wings of the conduit are not very deformable.

It is the object of the present invention to make an ease-to-assembly fender which better complies with the non-linearity of the edge of the boats.

According to the invention, this object is achieved by a fender for boats consisting of an internal portion fixed to an edge of the boat and of an external portion adapted to absorb external shocks, characterised in that said external portion comprises an internal conduit adapted to couple with a complementarily shaped protuberance belonging to said internal portion.

Since the conduit is not comprised, the internal portion may have a shape which improves elasticity and deformability to the advantage of its interfacing capability with the irregular edge of the boat.

These and other features of the present invention will be further explained in the following detailed description of a practical embodiment shown by the way of non-limitative example in the attached drawings, in which.

Figure 1:
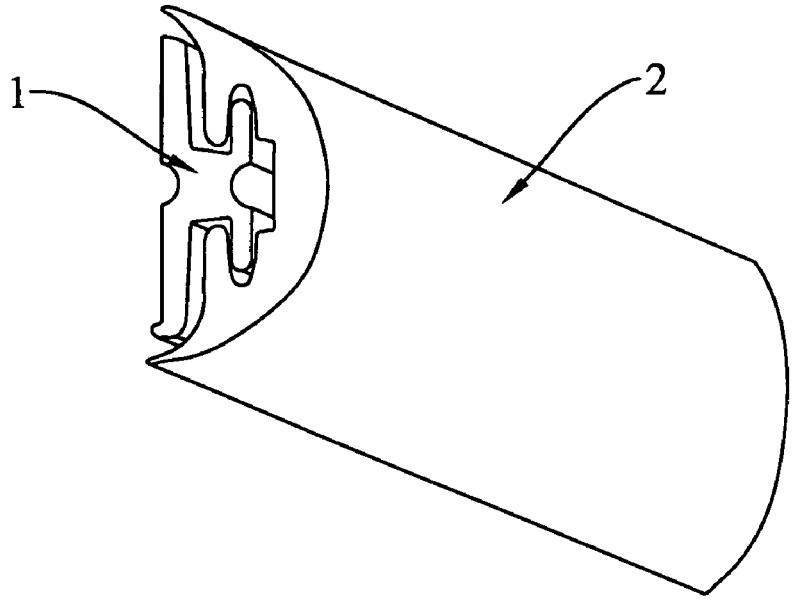
FIG. 1 shows a perspective view of the fender according to the present invention.
Figure 2:
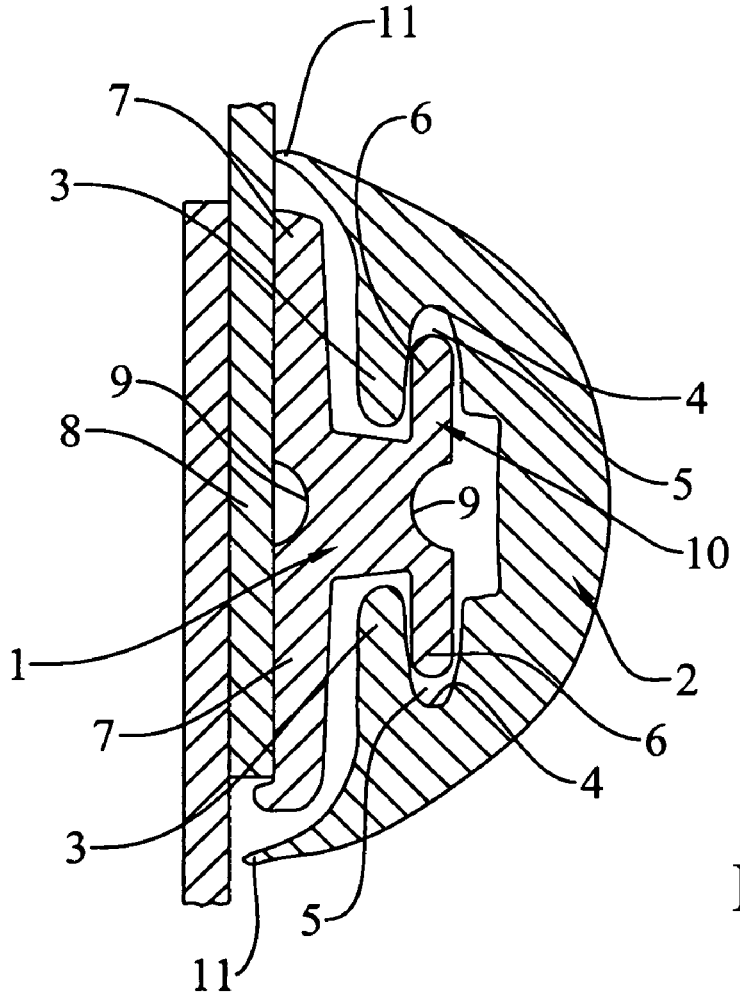
FIG. 2 shows a cross-section of the fender in FIG. 1 fixed to the edge of a boat.

The fender shown in the figures consists of an internal portion 1 for fixing to an edge 8 of the boat and an external portion 2 adapted to absorb possible external shocks.

External portion 2 comprises internal convexities 3 and consequent concavities 4 adapted to define the internal surface of a conduit 5 engageable with a pair of fins 6 forming a protuberance 10 of internal portion 1.

The latter 1 also comprises wings 7 adapted to rest on edge 8 and to be fixed to the latter by means of fastening means (not shown) and longitudinal grooves 9 for improving elasticity and deformability of fins 6 and wings 7.

Essentially, internal portion 1 is H-shaped and the external surface of external portion 2 is a 'half' cylinder which completely covers internal portion 1 also by terminal fins 11.

The internal portion is made of rigid PVC, while the external portion is made of soft PVC. More in general, external portion 2 is made of softer material with respect to internal portion 1.

Assembly of the fender is extremely easy.

Internal portion 1 is positioned and fixed to the edge. The H-shape facilitates interfacing with the not perfectly linear edge 8 of the boat.

Grooves 9 favour absorption of possible torsions of internal part 1 due to creaking of the boat hull caused by wear.

The deformability and elasticity of convexities 3 allow easy cold assembly of external portion 2. Also fins 6 are slightly deformable to rapidly engage conduit 5.

The presence of conduit 5 in external portion 2, i.e. in the softer portion, allows a considerable deformation capacity of the conduit 5 itself.

The H-shape of internal portion 1 enhances deformability and elasticity.

The presence of conduit 5 in external portion 2, i.e. in the portion not firmly fixed to edge 8 of the boat, is therefore decisive.

The possible wear of conduit 5 does not require the removal of the internal portion 1 fixed to the boat. The replacement of the external portion 2 is much faster.

The invention claimed is:

1. A boat fender comprising an internal portion fixed to an edge of a boat, and an external portion adapted to absorb external shocks, said external portion including an internal conduit adapted to couple with a complementarily shaped protuberance belonging to said internal portion, a cross-section of the internal portion being essentially H-shaped and including a plane portion resting on the edge of the boat and a solid thick shank portion perpendicularly extending from the plane portion and projecting to a pair of thin convex fins laterally extending from said shank portion and said pair of thin convex fins extending parallel to said plane portion, said thin convex fins fitting within and including a gap from respective internal concave grooves of said external portion and cooperating by the gap to maintain said external portion spaced from said plane portion of the internal portion.

2. The boat fender according to claim 1, wherein said internal portion includes longitudinal grooves for increasing deformation capability of the fins and the wings.

3. The boat fender according to claim 1, wherein an external surface of the external portion is essentially a 'half' cylinder.

4. The boat fender according to claim 1, wherein both the internal portion and the external portion are made of PVC, and the internal portion is stiffer than the external portion.

* * * * *